US007263787B2

(12) United States Patent
Besaw

(10) Patent No.: US 7,263,787 B2
(45) Date of Patent: Sep. 4, 2007

(54) LAUNDRY DRYER WITH IMPROVED TUMBLER AIR FLOW PASSAGE OPENINGS

(75) Inventor: Mike Besaw, Neshkoro, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 0 days.

(21) Appl. No.: 11/184,675

(22) Filed: Jul. 19, 2005

(65) Prior Publication Data

US 2007/0017119 A1 Jan. 25, 2007

(51) Int. Cl.
*F26B 19/00* (2006.01)

(52) U.S. Cl. ..... 34/62; 34/602; 34/603

(58) Field of Classification Search ..... 34/62, 34/602, 603
See application file for complete search history.

(56) References Cited

U.S. PATENT DOCUMENTS 2,660,870 A * 12/1953 Kennedy ..... 68/24
3,292,347 A * 12/1966 Hodgkinson ..... 261/83
5,548,904 A 8/1996 Rood
2004/0004032 A1* 1/2004 Burger et al. ..... 209/233

FOREIGN PATENT DOCUMENTS

EP 0103418 A3 3/1984

* cited by examiner

*Primary Examiner*—S. Gravini
(74) *Attorney, Agent, or Firm*—Leydig, Voit & Mayer, Ltd.

(57) ABSTRACT

A laundry dryer having a tumbler with airflow openings of generally triangular shape with rounded transverse sides and opposed ends configured to permit passage of round heads of standard drywall screws when oriented parallel to the long dimension of the opening, while preventing the passage of standard collar buttons having a diameter no greater than the diameter of the drywall screw heads. Loose drywall screws within the tumbler are thereby permitted to pass harmlessly through the air flow openings in the rotating drum into the lint filter of the dryer without damage to the dryer nor interruption of the dryer operation.

15 Claims, 3 Drawing Sheets

LAUNDRY DRYER WITH IMPROVED TUMBLER AIR FLOW PASSAGE OPENINGS

FIELD OF THE INVENTION

The present invention relates generally to laundry machines, and more particularly, to tumbler dryers for drying laundered items.

BACKGROUND OF THE INVENTION

Problems in the operation of tumbler dryers often arise by reason of items left in the pockets of clothes or other garments being laundered. Users of laundry machines in coin operated laundries frequently do not clean out pockets of the clothing and dry wall screws and nails inadvertently left in the pockets during laundering can work their way free and migrate to the outer wall of the rotating tumbler drum or basket by reason of centrifugal forces. Such dry wall screws and nails quickly find their way through one of the many airflow holes in the perforated tumbler basket with the heads of the fasteners, which are larger than the tumbler basket openings, retaining the screws in outwardly protruding relation to the tumbler basket such that continued rotation of the tumbler under the power of the laundry machine drive motor causes these screws to gouge and cut a circular ring in the tumbler. The resulting damage is very expensive and time consuming to repair. Dry wall screws and nails are particularly troublesome since the thread-like ridges in the shank of the fastener tend to resist dislodgement of the screw from the tumbler opening when engaging the surrounding dryer panels. Moreover, upon tearing an opening in the surrounding dryer panel ambient air is permitted to enter the tumbler from the torn opening, rather than from the heated air inlet, which in turn can lead to overheating at the inlet of the dryer and the potential for fire.

Proposals to make airflow openings in the dryer tumbler larger to permit free passage of the dry wall screw heads have proven unsuccessful. If the airflow holes of the tumbler are made sufficiently large to permit passage of drywall screws, buttons on garments being dried, and particularly relatively small collar buttons, also can pass through the airflow openings and become trapped in the airflow opening, causing rippage and damage to the clothing. In fact, the tumblers of dryers typically have a standard airflow hole size of 0.312 inches, which is slightly smaller than the diameter of the common shirt collar button. Due to such relatively small airflow openings, tumblers must be manufactured with a high density of such openings to permit adequate airflow during operation of the dryer. Malfunction detection systems, such as shown in U.S. application Ser. No. 10/875,002 filed Jun. 22, 2004, for monitoring and shutting down operation of the dryer in the event of such protruding dry wall screws are relatively complicated and expensive.

OBJECTS AND SUMMARY OF THE INVENTION

It is an object of the present invention to provide a laundry machine that is adapted for more reliable operation.

Another objection is provide a laundry machine as characterized above, and particularly a tumbler dryer, that permits dry wall screws, nails and like fasteners to pass through the airflow openings in the dryer tumbler without damage to the dryer, while restricting the passage of garment buttons of substantially similar or even smaller diameter.

A further object is to provide a tumbler laundry dryer of the above kind that has relative large area airflow openings that facilitate efficient drying performance.

Other objects and advantages of the invention will become apparent upon reading the following detailed description and upon reference to the drawings, in which:

BRIEF DESCRIPTION OF THE DRAWING(S)

Figure 1:
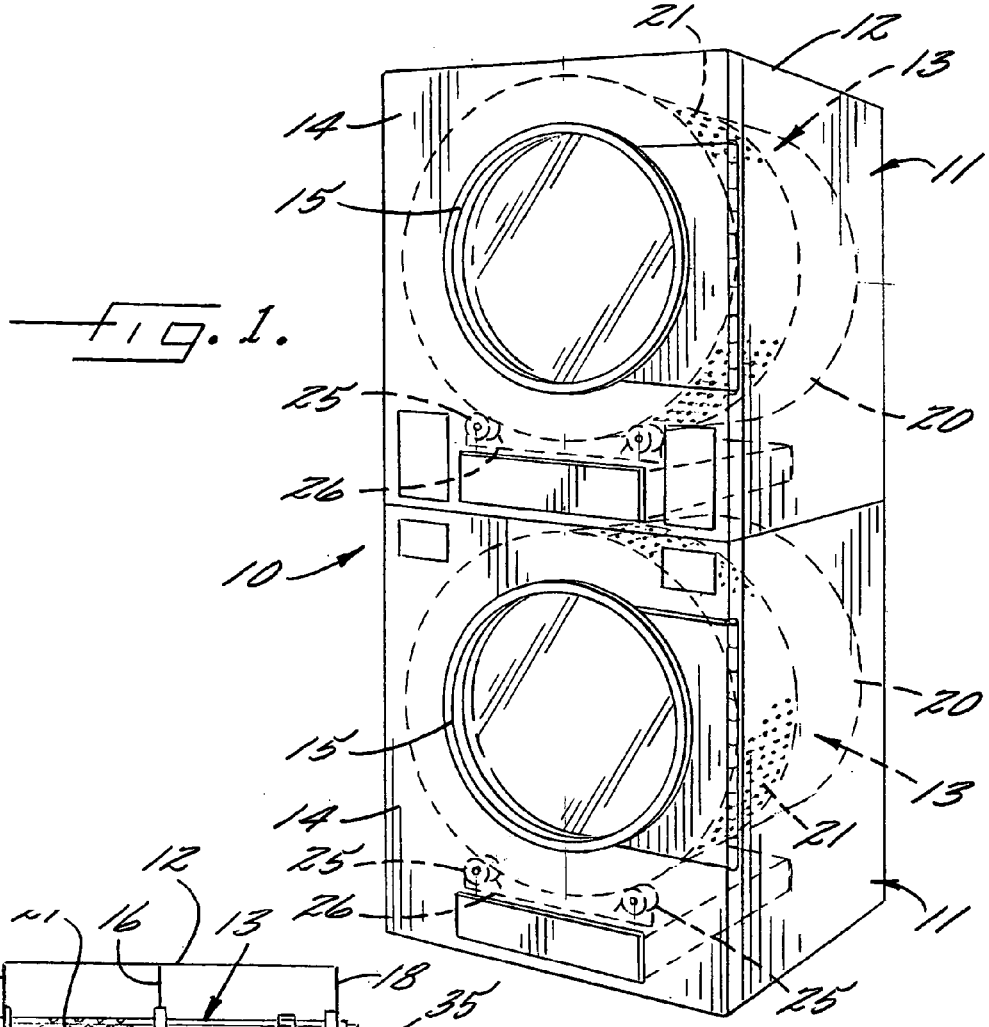
FIG. 1 is a perspective of a laundry machine having a pair of vertically stacked tumbler dryers in accordance with the invention.
Figure 2:
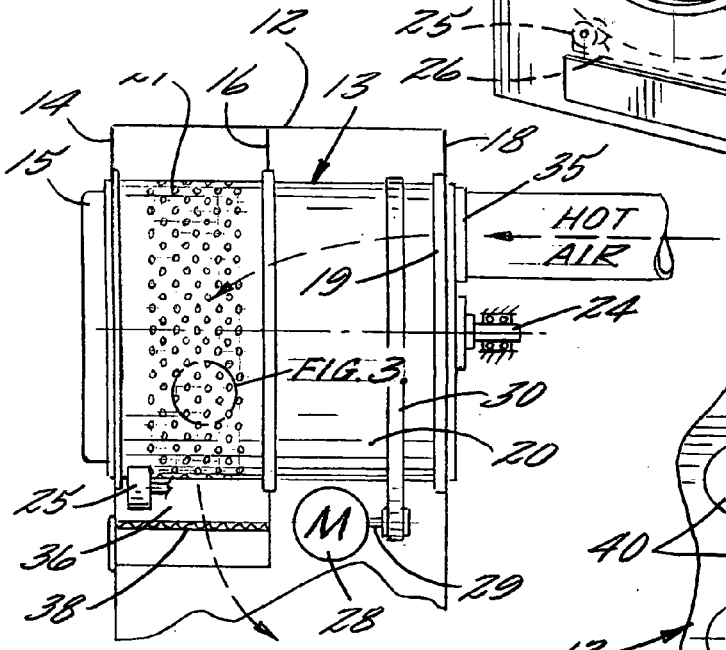
FIG. 2 is a partially diagrammatic side elevational view of one of the illustrated tumbler dryers.
Figure 3:
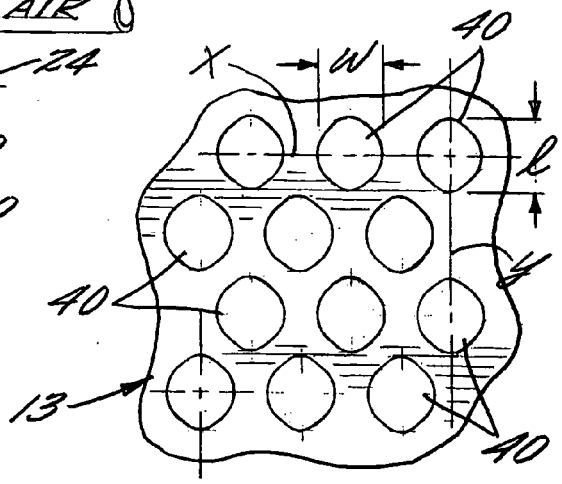
FIG. 3 is an enlarged fragmentary plan view of the airflow openings in the tumbler basket of the illustrated dryer, taken in the encircle area of FIG. 2.
Figure 4:
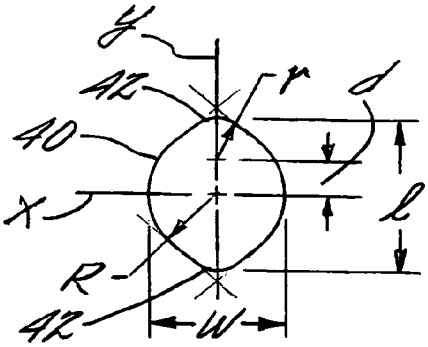
FIG. 4 is an enlarged plan view of one of the airflow openings.

While the invention is susceptible of various modifications and alternative constructions, a certain illustrated embodiment thereof has been shown in the drawings and will be described below in detail. In should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to the drawings, there is shown an illustrative laundry machine 10 in accordance with the invention, which in this case includes a pair of vertically stacked tumbler dryers 11 that basically operate in a conventional manner. Since the dryers are identical in construction and operation, only one need be described in detail.

The illustrated dryer 11 includes a cabinet 12 within which a front opening garment containing tumbler basket 13 is disposed for relative rotational movement. The cabinet 12 includes a front panel 14 adjacent to which a conventional door 15 is mounted, a center panel 16, and a rear panel 18. The tumbler basket 13 has a perforated rear axial end 19 through which heated air is introduced into the tumbler basket 13 in a conventional manner, a rearward unperforated cylindrical portion 20 disposed in sealed relation between the rear panel 18 and the center partition 16, and a forward perforated cylindrical portion 21 disposed between the center partition 16 and the front panel 14. The tumbler basket 13 is supported for rotational movement by a rearwardly extending axle 24 and a pair of rollers 25 mounted in a roller bracket 26 fixed within the cabinet 12 below a front end of the tumbler basket 13.

For rotatably driving the tumbler basket 13, a drive motor 28 with a drive shaft 29 is provided for driving a belt 30. As is known in the art, through operation of an appropriate motor driven fan, hot air is drawn from a heater, which may be either gas or electric powered, disposed on a rear side of the dryer, through an air inlet 35 communicating with the perforated rear axial end 19 of the basket 13, through the basket and out an air outlet 36 communicating with the forward perforated basket portion 21, through a lint filter 38, and then from the fan to the outside environment.

Figure 7:
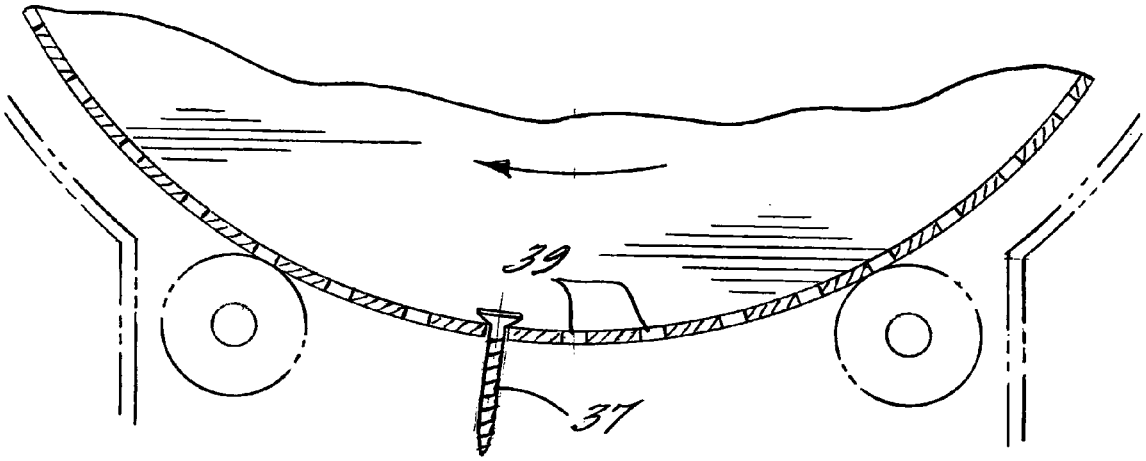
Fig. 7. (PRIOR ART)
FIG. 7 is an enlarged fragmentary section of a prior art tumbler dryer with a drywall screw fixed in outwardly protruding relation to the tumbler basket during operation of the dryer.

During operation of the dryer 11, heated air is directed into and through the tumbler basket 13 as the basket is rotatably driven by the motor 28 and belt 30, causing laundered items within the basket 13 to be tumbled for enhancing air circulation and drying. As indicated above, items inadvertently left in pockets of the garments being laundered can become loose in the tumbler basket 13. In a conventional dryer as depicted in FIG. 7, items 37, such as dry wall screws and nails, can quickly migrate in position such that they extend radially outwardly through apertures 39 in the forward perforated section of the basket, being retained in the perforated basket wall by the head of the fastener as illustrated. Due to the rapid rotation of the basket necessary for thorough tumbling of the items being dried, such outwardly extending obstructions can quickly gauge and tear the sheet metal interior walls of the dryer cabinet, not only damaging the dryer but also enabling outside air to enter the basket through the torn opening, thereby interrupting the airflow from the heated air inlet and causing a dangerous rapid rise in temperature at the inlet.

In accordance with the invention, the tumbler basket of the dryer has elongated airflow openings which permit harmless passage of drywall screws and like fasteners through the airflow openings without damage to the dryer, while restricting the passage of garment buttons having diameters no greater than the diameter of the fastener heads. To this end, in the illustrated embodiment, the tumbler basket has oblong, generally triangular configured air flow openings 40 having a central transverse width "w" along a transverse axis "x" of the opening no greater than the diameter of a standard drywall screw head or collar button and a long dimension "l" along a long axis "y" of the opening 40 greater than the diameter of both a standard drywall screw head and collar button. The airflow openings 40 in this case each have a rounded diamond configuration defined in part by a central radius section 41 having a radius "R" and a long dimension "1" defined by relatively smaller radiused sections 42 at opposed elongated ends of the opening 40 each having a radius "r" with respective centers offset from the center of the central radiused section 41 by a distance "d" along the long axis "y". As is known in the art, typical small collar buttons, herein referred to as "standard collar buttons", have a dimension of about 0.338 inches and the heads of common No. 6 drywall screws, herein referred to as "standard drywall screws", typically have a substantially similar or slightly larger diameter. In the preferred embodiment, the openings 40 have a transverse width "w" of about 0.312 inches, typical of the diameter of conventional drywall tumbler airflow openings, and an elongated length "1" of 0.346 inches, larger than the diameter of a standard drywall airflow opening, defined by the radiused sections 42 having a radius "r" of 0.094 inches and being offset a distance "d" of 0.0794 inches from the central axis of the opening.

Figure 5:
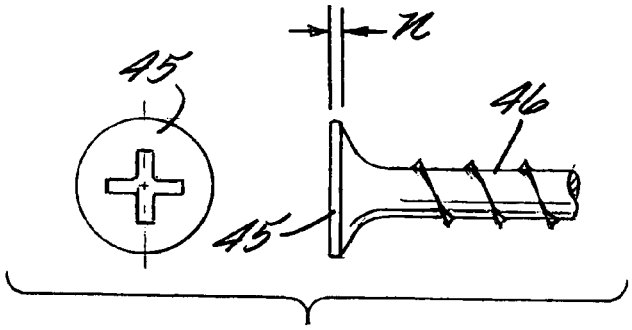
FIG. 5 is an end and side views of a typical drywall screw.
Figure 5A:
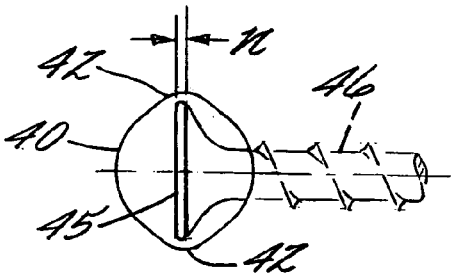
FIG. 5A is a side view of the illustrated drywall screw with the head thereof shown in position for passage through an airflow opening of the illustrated dryer basket.
Figure 6:
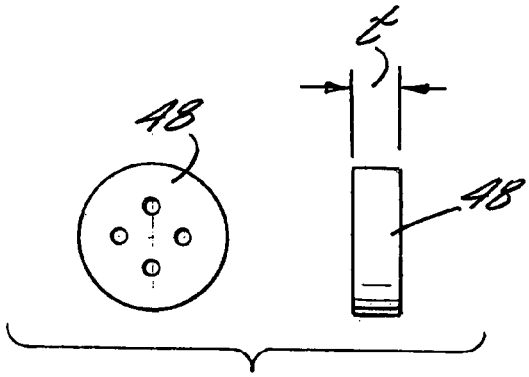
FIG. 6 is an end and side elevational views of a typical collar button.
Figure 6A:
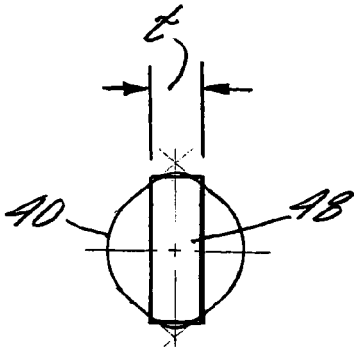
FIG. 6A is a side view of the illustrated collar button in relation to one of the airflow openings of the illustrated tumbler dryer basket, being blocked from passage therethrough.

In carrying out the invention, the radiused sections 42 define relatively narrow ends of the elongated airflow opening sufficiently wide to permit transverse passage of head 45 of a standard drywall screw 46, as depicted in FIG. 5A, but insufficiently wide to permit transverse passage of a standard collar button 48, as depicted in FIG. 6A. The heads of standard drywall screws, as depicted in FIG. 5, typically have a relatively narrow width "n" between about 0.034 and 0.045 inches, which taper inwardly to the smaller diameter shank of the screw. Standard collar buttons 48, on the other hand, have a substantially greater thickness "t" on the order of 0.095 inches.

It will be seen that since the transverse width "w" of the airflow opening is less than the diameter of both a standard collar button 48 and drywall screw head 45, neither can pass transversely through the airflow opening 40 when oriented parallel to the transverse axis "x" of the opening. Moreover, while the long dimension "l" of the airflow opening 40 is greater than the diameter of the standard collar button 48, the smaller radiused sections 42 that define opposed ends of the opening 40 define a transverse width less than the width of the collar button, thereby preventing the collar button from proceeding transversely through the airflow opening 40 when oriented parallel to the long axis "y" of the opening. On the other hand, since the long dimension "l" of the airflow opening 40 is greater than the diameter of the drywall screw head 45 and the drywall screw head 45 has a relatively narrow depth less than the width of the ends of the airflow opening 40 defined by the small radius sections 42, the drywall screw head 45 can pass through the opening 40 when oriented parallel to the long axis "y" of the opening.

During operation of the dryer, therefore, drywall screws 46 or like fasteners left in the pockets of garments being laundered that become loose in the dryer tumbler ultimately, due to the tumbling motion, will become oriented with the screw head 45 parallel to the long axis "y" of the tumbler opening 40, permitting the screw to pass through the drywall opening 40 and into the lint trap 38 of the laundry machine without damage to the dryer during its continued operation. On the other hand, the airflow openings 40 will prevent the passage of standard small collar buttons 48, and thus prevent the buttons 48 from being trapped in the airflow openings 40 with resulting tearing or damage to the garment. Moreover, the drywall screws 46 that pass through the airflow openings 40 can be easily removed during normal cleaning of the lint trap 38 without interruption of the dryer operation.

In keeping with the invention, the tumbler airflow openings 40 have a relatively large area, compared to the openings of conventional dryer tumblers, for facilitating efficient drying performance. In the illustrated embodiment, the area of the oval airflow openings 40 is 0.08021 sq. inches. Conventional tumbler airflow openings having a standard 0.312 inch diameter define a smaller air passage area of 0.07645 sq. inches. It will be understood that while the illustrated airflow openings 40 have a generally triangular shape with rounded sides and ends, alternatively other oblong or diamond shapes could be used so long as the transverse width and long dimensions of the opening both prevent transverse passage of standard collar button and at least the long dimension of the openings permits ultimate free transverse passage of standard drywall screw heads.

From the foregoing, it can be seen that the tumbler dryer of the present invention is adapted for more reliable operation. The dryer tumbler permits free passage of drywall screws, nails and like fasteners through the airflow openings as an incident to dryer operation without damage to the dryer or interruption in its operation, while effectively restricting the passage of garment buttons of substantially similar or even smaller size, which could result in tearing and damage to garments. The airflow openings of the tumbler dryer of the present invention also define larger air passage areas than conventional tumbler dryers for facilitating efficient drying.

The invention claimed is:

1. A laundry machine comprising a cabinet, a tumbler for containing launderable items rotatably support within said cabinet, said tumbler having an access opening for permitting insertion and removal of launderable items into and from said tumbler, a drive for rotating said tumbler during operation of said laundry machine, said tumbler having an outer cylindrical wall portion formed with multiplicity of air flow openings, said openings having an elongated configuration having a relatively long dimension "l" greater than 0.338 inches and a transverse width "w" less than 0.338 inches but greater than the diameter of a shank of a standard No. 6 drywall screw having a head with a diameter of about 0.338 inches or greater, said elongated openings having opposite elongated ends configured to prevent passage of a standard collar button having a diameter of about 0.338 inches and an axial thickness of about 0.095 inches when oriented parallel to the long dimension of the opening while permitting passage of the round head of a standard No. 6 drywall screw having an axial thickness less than the axial thickness of the standard collar button when the head of the drywall screw is oriented parallel to the long dimension of the elongated opening.

2. The laundry machine of claim 1 in which said elongated openings have a generally triangular shape.

3. The laundry machine of claim 1 in which transverse sides and opposite elongated ends of said openings are defined by radiused sections, and the radiused sections at said opposed elongated ends having a radius smaller than the radius of said opposite transverse sides.

4. The laundry machine of claim 1 in which said elongated openings are defined by a central radiused section and relatively smaller radiused sections at opposite elongated ends of the openings, said smaller radiused sections at said elongated ends having respective center points each offset a common distance "d" an opposite side of the center of said central radiused section.

5. The laundry machine of claim 4 in which said smaller radiused sections define relatively narrow opposed ends of the elongated openings sufficiently wide to permit transverse passage of the ground head of a standard drywall screw, but insufficiently wide to permit transverse passage of a standard collar button.

6. The laundry machine of claim 1 in which said openings have a transverse width "w" of about 0.312 inches.

7. A tumbler dryer comprising a cabinet, a tumbler for containing launderable items rotatably support within said cabinet, said tumbler having an access opening for permitting insertion and removal of launderable items into and from said tumbler, a drive for rotating said tumbler during operation of said laundry machine, said tumbler having an outer cylindrical wall portion formed with multiplicity of air flow openings to permit heated air to be directed into and through the basket during operation of the dryer, said openings having an elongated configuration having a relatively long dimension "l" greater than 0.338 inches and a transverse width "w" less than 0.338 inches but greater than the diameter of a shank of a standard No. 6 drywall screw having a head with a diameter of about 0.338 inches or greater, said elongated openings each having opposite elongated ends configured to prevent passage of a standard collar button having a diameter of about 0.338 inches and an axial thickness of about 0.095 inches when oriented parallel to the long dimension of the opening while permitting passage of the rounded head of a standard No. 6 drywall screw having an axial thickness of between about 0.034 and 0.045 inches wherein the head of the drywall screw is oriented parallel to the long dimension of the elongated opening.

8. The tumbler dryer of claim 7 in which said elongated openings have a generally triangular shape.

9. The tumbler dryer of claim 7 in which said elongated openings are defined by a central radiused section and relatively smaller radiused sections at opposite elongated ends of the openings, said smaller radiused sections at said elongated ends having respective center points each offset a common distance "d" an opposite side of the center of said central radiused section.

10. The tumbler dryer of claim 9 in which said openings have a transverse with "w" of about 0.312 inches, and said smaller radiused sections define relatively narrow opposed ends of the elongated openings sufficiently wide to permit transverse passage of the ground head of a standard drywall screw, but insufficiently wide to permit transverse passage of a standard collar button.

11. A tumbler dryer comprising a cabinet, a tumbler for containing launderable items rotatably support within said cabinet, said tumbler having an access opening for permitting insertion and removal of launderable items into and from said tumbler, a drive for rotating said tumbler during operation of said laundry machine, said tumbler having an outer cylindrical wall portion formed with multiplicity of air flow openings to permit heated air to be directed into and through the basket during operation of the dryer, said openings having an elongated configuration having a transverse width "w" and a relatively long dimension "l", said elongated openings a generally triangular shape defined by a central radius section and relatively smaller radiused sections at opposite elongated ends of the opening, said long dimension "l" being greater than 0.338 inches and said transverse width "w" being less than 0.338 inches but greater than the diameter of a shank of a standard No. 6 drywall screw having a head with a diameter of about 0.338 inches or greater, said smaller radiused sections at said opposite elongated ends having respective center points each offset a common distance on opposite sides of the center of said central radius section and sized to prevent passage of a standard collar button having a diameter of about 0.338 inches and an axial thickness of about 0.095 inches when oriented parallel to the long dimension of the opening while permitting passage of a round head of a standard No. 6 drywall screw having a diameter of about 0.338 inches or greater and an axial thickness less than the axial thickness of the standard collar button when the head of the drywall screw is oriented parallel to the long dimension of the elongated opening.

12. The tumbler dryer of claim 11 in which said central radius section has a radius of at least 50% greater than said smaller radiused sections.

13. The tumbler dryer of claim 11 in which said smaller radius sections are offset from the center of said central radius section by a distance of at least 50% of the radius of said central radius section.

14. The tumbler dryer of claim 11 in which said smaller radiused sections define relatively narrow opposed ends of the elongated openings sufficiently wide to permit transverse passage of the ground head of a standard drywall screw, but insufficiently wide to permit transverse passage of a standard collar button.

15. The tumbler dryer of claim 11 in which said openings have a transverse width "w" of about 0.312 inches.

* * * * *